US005785210A

United States Patent [19]

Amberg et al.

[11] Patent Number: 5,785,210

[45] Date of Patent: Jul. 28, 1998

[54] PASTE CONTAINER AND DISPENSER

[75] Inventors: Guenther Amberg, Neuss; Edgar Koeppelmann, Hilden; Walter Eichner, Siegsdorf, all of Germany

[73] Assignee: Henkel-Ecolab GmbH & Co. OHG, Duesseldorf, Germany

[21] Appl. No.: 619,739

[22] PCT Filed: Sep. 19, 1994

[86] PCT No.: PCT/EP94/03211

§ 371 Date: Mar. 27, 1996

§ 102(e) Date: Mar. 27, 1996

[87] PCT Pub. No.: WO95/09263

PCT Pub. Date: Apr. 6, 1995

[30] Foreign Application Priority Data

Sep. 27, 1993 [DE] Germany ..... 43 32 850.4

[51] Int. Cl.[6] ..... G01F 11/00

[52] U.S. Cl. ..... 222/229; 222/235; 222/386; 222/405; 222/408.5

[58] Field of Search ..... 222/228, 229, 222/232, 233, 234, 235, 319, 386, 405, 408.5, 413

[56] References Cited

U.S. PATENT DOCUMENTS

| | | | |
|---|---|---|---|
| 2,385,579 | 9/1945 | King et al. | 222/235 X |
| 3,722,715 | 3/1973 | Young | 222/234 X |
| 3,824,937 | 7/1974 | Turner et al. | 222/228 X |
| 3,951,462 | 4/1976 | De Francisci | 222/405 X |
| 4,635,820 | 1/1987 | Marshall | 222/405 X |
| 4,889,644 | 12/1989 | Amberg et al. | 252/8.9 |
| 4,967,810 | 11/1990 | Arashida | 141/59 |
| 5,078,304 | 1/1992 | Schneider | 222/405 X |
| 5,167,350 | 12/1992 | Amberg et al. | 222/190 |
| 5,221,488 | 6/1993 | Amberg et al. | 252/8.9 |

FOREIGN PATENT DOCUMENTS

| | | | |
|---|---|---|---|
| 0340588 | 11/1989 | European Pat. Off. . | |
| 1208460 | 1/1966 | Germany . | |
| 1585592 | 4/1971 | Germany . | |
| 3719906 | 12/1988 | Germany . | |
| 3826110 | 2/1990 | Germany . | |
| 4072190 | 3/1992 | Japan | 222/235 |
| WO 8200753 | 3/1982 | WIPO . | |

*Primary Examiner*—Joseph Kaufman
*Attorney, Agent, or Firm*—Ernest G. Szoke; Wayne C. Jaeschke; Daniel S. Ortiz

[57] ABSTRACT

A dispenser container for a paste is provided. The dispenser container is formed from a cylinder open at one end for holding the paste, a displaceable tightly fitted follower plate means is arranged at the open end of the cylinder and a dispenser for transporting the paste from the container is arranged to cooperate with the follower plate. A motor and transmission are mounted near the center of the follower plate and has a shaft which extends through the follower plate and has mounted thereon a multiple blade stirrer. The stirrer rotates in the paste below the follower plate. The dispenser removes the paste from the container at a position away from the center of the follower plate in an area below which the multiple blade stirrer rotates. The multiple blade stirrer by rotating in the paste lowers the viscosity and permits the paste to be more easily transported from the container by the dispenser.

20 Claims, 1 Drawing Sheet

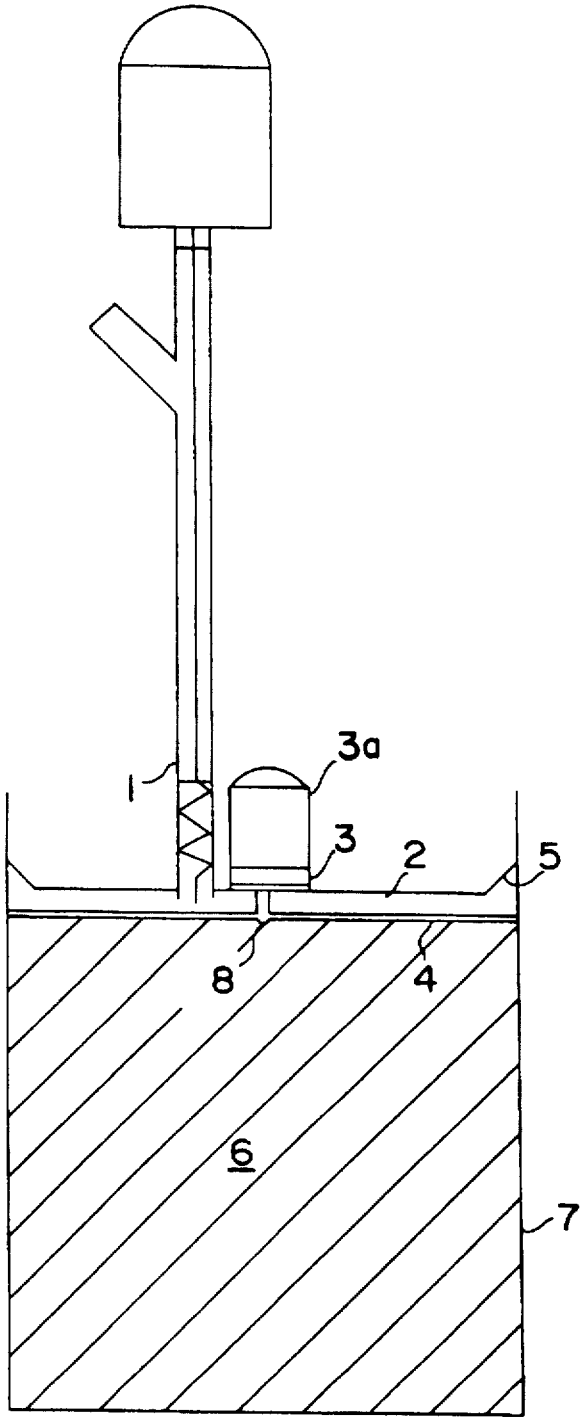
3a
1
3
2
5
8
4
6
7

PASTE CONTAINER AND DISPENSER

FIELD OF THE INVENTION

This invention relates to a paste container and dispenser which is particularly suitable for dispensing pseudoplastic pastes, more particularly highly viscous detergent pastes of the type used in institutional laundries.

BACKGROUND OF THE INVENTION

Paste-form detergents are used in particular in institutional laundries where they have the advantages of powder-form detergents, more particularly a high active-substance content, and none of the disadvantages of liquid detergents, more particularly the water or solvent content. Disadvantages of paste-form detergents can lie in packaging and dispensing problems.

RELATED ART

German patent application DE-A-37 19 906 describes a detergent container and dispenser. The storage container for the paste-form detergent is a container with rigid outer walls and a circular or square cross-section which is equipped on one side with a displaceable, tightly closing plate (follower plate). Under the effect of its weight, the follower plate applies pressure to the surface of the paste and enables the detergent paste to be withdrawn via the dispenser which may be formed by a simple pipe and pump. As the amount of paste decreases, the follower plate slowly follows the paste level downwards. The container and dispenser described in DE-A-37 19 906 may also be equipped with a mixing unit which mixes water simultaneously introduced into the dispenser with the detergent paste and thus forms a water-containing liquid concentrate which can be delivered to the individual washing machines.

German patent application DE-A-38 26 110 also describes a detergent container and dispenser for paste-form detergents. In this case, the detergent container is cylindrical with an opening at both ends. One opening is closed by a plate which is arranged in the container and designed for displacement axially thereof. The container opening situated opposite this displaceable plate carries a releasable connecting element with which it can be fixed or coupled to the dispenser. The connected dispenser comprises a plunger which acts on the displaceable plate of the paste container and causes it to advance as the paste is removed.

Unfortunately, the dispensing systems described above are only suitable for pastes with relatively low viscosities, more particularly in the range from about 75,000 mPa.s to 90,000 mPa.s. Pastes with higher viscosities in the range from about 150,000 mPa.s to 250,000 mPa.s are difficult or even totally impossible to pump with conventional dispensing systems, for example of the type described above, with the result that complete emptying is not possible in the removal of high-viscosity pastes.

BRIEF DESCRIPTION OF THE INVENTION

Accordingly, the problem addressed by the present invention was to provide a paste container and dispenser which would even enable pastes with high viscosities under normal conditions to be continuously removed by a dispensing and transporting system and, at the same time, would achieve a high degree of residual emptying of the paste container.

The present invention relates to a paste container and dispenser consisting of a cylinder (7) open at one end, a displaceable tightly closing follower plate (2) arranged at the open end of the cylinder and a dispenser (1) for removing and transporting the paste.

A. the follower plate (2) supporting a motor and transmission system (3), on the shaft of which—projecting centrally through the follower plate (2)—a multiple-blade stirring propeller (4) is arranged in such a way that it is able to rotate freely in the paste just below the follower plate (2) and B. the dispenser (1) being connected to the follower plate (2) outside the center thereof and above the area covered by the stirring propeller (4) and transporting the paste—optionally through a metering unit—to its point of use.

BRIEF DESCRIPTION OF THE FIGURE

The FIGURE is a diagrammatic representation in cross-section of a dispenser of the invention.

DETAILED DESCRIPTION OF THE INVENTION

The paste container and dispenser according to the invention is particularly suitable for pseudoplastic pastes of high viscosity. Pseudoplastic pastes have the property whereby they become liquid on exposure to mechanical forces, for example during stirring, shaking or ultrasonication, but solidify again after removal of the mechanical force. This means that the viscosity of these pastes decreases under the effect of increasing shear stress or shear rate. Particularly suitable pastes are those of which the viscosity, as measured for example with a Brookfield® DV-II or DV-IIplus rotational viscosimeter, spindle No. 7, at 25° C. and with minimal shearing, is above 100,000 mPa.s and, more particularly, in the range from 150,000 mPa.s to 500,000 mPa.s at 5 revolutions per minute and below 100,000 mPa.s and, more particularly, in the range from 10,000 mPa.s to 90,000 mPa.s at high shear rates, for example of 50 revolutions per minute. Corresponding pastes are, for example, the paste-form detergents obtainable in accordance with hitherto unpublished German patent application P 43 32 843.0 in the name of Henkel KGaA. Accordingly, a paste container according to the invention is preferably used for transporting and dispensing corresponding pseudoplastic detergent pastes.

According to the invention, the cylindrical paste container is closed at its open end by a displaceable, tightly closing plate which is designed for displacement in axial direction of the container. The displaceable plate is intended to seal off the container wall according to the particular paste level to such an extent that the paste is unable to escape in this zone, i.e. the plate best rubs gently against the container wall during its displacement. The plate is normally flat. At the same time, the sealing effect is improved by designing the plate so that it fits exactly in the container. To prevent the displaceable plate from tilting, its edge is best bent upwards in the shape of a collar, i.e. the plate is in the form of a flat piston. The plate is preferably provided with a plastic seal at its edges.

Disposed in the middle of the plate on the outside of the container is a motor and transmission system on whose shaft, which best coincides with axis of the cylindrical container, a multiple-blade stirring propeller is arranged beneath the plate towards the middle of the container. This stirring propeller is arranged in such a way that it is able to rotate freely just below the follower plate. The distance of the stirring propeller from the follower plate is preferably as small as possible because the underneath of the plate can be simultaneously freed from paste, i.e. cleaned, by the propeller blades, which results in a reduction of unwanted residues on the plate. An excessive distance would mean that the motor would need an unnecessarily large amount of energy to shear the paste. In addition, when the stirring propeller arrives at the bottom of the cylindrical container, there would still be detergent paste above the stirring propeller which would no longer be removed from the container on account of the excessive distance of the dispenser. The distance of the stirring propeller from the plate is preferably 0.8 to 5 mm and more preferably 1 mm to 3 mm.

The stirring propeller has at least two blades. The blades of the stirring propeller may be equal or different in length. The stirring propeller preferably has four blades, the opposite blades preferably being equal in length. One preferred embodiment uses a four-blade stirring propeller which has two opposite blades of which the length is such that they cover the entire diameter of the cylindrical container. By contrast, the other two blades are only so long that the ends extend up to the dispenser likewise disposed on the plate. An embodiment such as this is of particular advantage where pseudoplastic pastes are used because it enables the two long blades to shear and hence liquefy the highly viscous paste while the two short blades are able to transport the paste towards the pump.

The blades of the stirring propeller normally assume the form of a flat rectangular slat or round bar. They are normally arranged parallel to the plate. In one possible embodiment, the blades are arranged at an angle of 90° to 60° to the propeller axis. This angle is preferably 89° to 65°. There is no need for all the blades to be arranged at the same angle to the displaceable plate. Where they are formed by slat-like elements, the propeller blades may even be slightly pitched. The angle of pitch is preferably between 5° and 45°.

In one preferred embodiment, the boss of the stirring propeller is shaped in such a way that it terminates the shaft of the stirring propeller at its lower end in the form of a projection. An arrangement such as this has the advantage that this projection can be used as a central spacer relative to the bottom of the container so that no excessive friction occurs when the propeller is at the bottom of the container.

The motor and transmission system used serves to drive the stirring propeller. The power of the motor is determined by the required speed of the stirring propeller and by the viscosity of the pseudoplastic paste used. The rotational speed of the stirring propeller is normally in the range from 5 to 180 r.p.m., preferably in the range from 15 to 180 r.p.m. and more preferably in range from 45 to 90 r.p.m. An excessive rotational speed is a disadvantage because the paste would then become excessively liquid and could escape at the edges of the plate. If the rotational speed is too low, the paste would not be sufficiently liquefied and continuous removal would be impaired.

As the paste is removed from the container, the plate sinks slowly according to the paste level. When the boss of the stirring propeller reaches the bottom of the container, the stirring propeller can continue to rotate for a while because, through the movement of the blades, the paste flows more easily from the edges of the container towards the middle and can be removed. The container can readily be emptied to residues of less than 1% by the dispenser according to the invention.

The dispenser is connected to the follower plate outside the middle thereof. The dispenser is preferably formed by an eccentric screw pump, gear pump, flow inducer or injector. Through the dispenser, the paste can be directly put to its use in basically known manner by way of corresponding consumption-controlled distributors.

The container together with the plate and the dispenser are best made of a corrosion-resistant material, such as plastic, metal or glass. In the interests of a sufficiently accurate fit, the container should remain substantially dimensionally stable in use. Although the size of the container is not critical, the contents should best last for several hours to minimize packaging and servicing costs. Corresponding paste containers normally have a volume of at least 0.2 liter. Where they are used as paste containers for institutional detergents, the containers normally have a capacity of the order of 200 liters.

One possible embodiment of the paste container and dispenser according to the invention is illustrated in the accompanying drawing.

The highly viscous paste 6 is accommodated in a cylindrical container 7 open at its upper end. The open end of the cylinder 7 is closed by the round plate 2 arranged in the container 7. The plate 2 is bent outwards in the shape of a collar and sealed by a plastic seal 5. The plate 2 lies on the paste and follows the paste downwards as it is removed. Disposed in the middle of the follower plate 2 is a motor **3*a* and transmission system 3 on the shaft of which a multiple-blade stirring propeller 4 is arranged. The shaft terminates in a boss 8 which projects slightly downwards. In the embodiment illustrated, all the blades are of equal length and extend over the entire diameter of the cylinder. These long blades also strip the paste from the cylinder wall, i.e. residues of paste on the container wall are minimized. The stirring propeller 4 is able to rotate freely under the follower plate 2. If pseudoplastic pastes of such high viscosity that the dispenser is unable to transport them without shearing are used, the propeller blades shear the upper layer of paste so that the viscosity of the paste is reduced to such an extent that it becomes dispensable. A dispenser 1 in the form of an eccentric screw pump is arranged outside the middle of the plate 2**. The sheared and viscosity-reduced paste is put to its use, for example in an institutional washing machine, by this pump, optionally via corresponding distributing and/or metering elements.

List of Reference Numerals

1 Dispenser
2 Follower plate
3 Transmission
**3*a*** Motor
4 Stirring blades
5 Seal
6 Paste
7 Paste container
8 Boss

We claim:

1. A paste container and dispenser comprising a cylinder (7) open at one end for holding the paste, a displaceable tightly fitted follower plate means (2) arranged at the open end of the cylinder, a dispenser means (1) for transporting the paste from the container, a motor and transmission means having a shaft means (3) projecting centrally through the follower plate (2); a rotatable multiple-blade stirring means (4) mounted on the shaft arranged to rotate in the paste below the follower plate means (2) arranged on the follower plate (2) outside the center thereof having means for communicating with the paste above an area covered by a blade of the stirring means (4) for transporting the paste from the container to a point of use.

2. The paste container and dispenser as claimed in claim 1, wherein the blades of the stirring means (4) comprise blades of at least two different lengths.

3. The paste container and dispenser as claimed in claim 2, wherein the stirring means (4) comprises at least four blades wherein at least two opposite blades span virtually the entire diameter of the paste container and at least two opposite blades have a span which extends to at least the portion wherein the dispenser (1) is in communication with the paste, during their rotation.

4. The paste container and dispenser as claimed in claim 3 wherein an angle between a shaft axis and the stirring means blade has a value of 90° to 60°.

5. The paste container and dispenser as claimed in claim 3 wherein the dispenser (1) comprises an eccentric screw pump.

6. The paste container and dispenser as claimed in claim 3 wherein the blades of the stirring means (4) are arranged at a distance of from 0.8 mm to 5 mm below the follower plate (2).

7. The paste container and dispenser as claimed in claim 2 wherein an angle between a shaft axis and the stirring means blade has a value of 90° to 60°.

8. The paste container and dispenser as claimed in claim 2 wherein the dispenser (1) comprises an eccentric screw pump.

9. The paste container and dispenser as claimed in claim 2 wherein the blades of the stirring means (4) are arranged at a distance of from 0.8 mm to 5 mm below the follower plate (2).

10. The paste container and dispenser as claimed in claim 2 wherein a boss (8) of the stirring means comprises a downward projection which terminates the shaft of the stirring means at its lower end.

11. The paste container and dispenser as claimed in claim 1 wherein an angle between a shaft axis and the stirring blade has a value of 90° to 60°.

12. The paste container and dispenser as claimed in claim 11 wherein the dispenser (1) comprises an eccentric screw pump.

13. The paste container and dispenser as claimed in claim 11 wherein the blades of the stirring means (4) are arranged at a distance of from 0.8 mm to 5 mm below the follower plate (2).

14. The paste container and dispenser as claimed in claim 1 wherein the dispenser (1) comprises an eccentric screw pump.

15. The paste container and dispenser as claimed in claim 14 wherein the blades of the stirring means (4) are arranged at a distance of from 0.8 mm to 5 mm below the follower plate (2).

16. The paste container and dispenser as claimed in claim 1 wherein the blades of the stirring means (4) are arranged at a distance of from 0.8 mm to 5 mm below the follower plate (2).

17. The paste container and dispenser as claimed in claim 1 wherein a boss (8) of the stirring means (4) comprises a downward projection which terminates the shaft of the stirring means (4) at its lower end.

18. The paste container and dispenser of claim 1 wherein the paste comprises a pseudoplastic detergent having a viscosity, measured at 25° C., above 100.000 mPa.s at a low shear rate of 5 revolutions per minute using a no. 7 spindle on a Brookfield Model DVII or DVII plus viscosimeter.

19. The paste container and dispenser of claim 18 wherein the paste has a viscosity at 25° C., of less than 100.000 mPa.s at a high shear rate of 50 revolutions per minute.

20. The paste container and dispenser of claim 1 wherein the paste is transported through a metering means arranged between the dispensing means and the point of use.

* * * * *